US008342622B2

(12) United States Patent
Soma et al.

(10) Patent No.: US 8,342,622 B2
(45) Date of Patent: Jan. 1, 2013

(54) LIQUID EJECTION APPARATUS AND METHOD

(75) Inventors: Tsunenori Soma, Kawasaki (JP); Junya Kawase, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 13/154,759

(22) Filed: Jun. 7, 2011

(65) Prior Publication Data

US 2011/0316912 A1 Dec. 29, 2011

(30) Foreign Application Priority Data

Jun. 25, 2010 (JP) ..... 2010-145434

(51) Int. Cl.
*B41J 29/38* (2006.01)
*B41J 2/17* (2006.01)

(52) U.S. Cl. ..... 347/9; 347/84

(58) Field of Classification Search ..... 347/9, 19, 347/84, 85

See application file for complete search history.

(56) References Cited

U.S. PATENT DOCUMENTS 7,004,575 B2 * 2/2006 Inoue et al. ..... 347/86
7,883,187 B2 * 2/2011 Kawase ..... 347/84

FOREIGN PATENT DOCUMENTS

JP 08-258287 A 10/1996

* cited by examiner

*Primary Examiner* — An Do
(74) *Attorney, Agent, or Firm* — Fitzpatrick, Cella, Harper & Scinto

(57) ABSTRACT

In a continuous liquid ejection apparatus, when pressurizing ink with a pump and initiating ejection, the problem of a stable ink column and droplets not being formed if ink is ejected in a low ink pressure state and large droplets or droplets with unstable flight directions being formed is solved. The space where droplets fly is sealed in order to raise the pressure of ink inside a liquid chamber communicating with a nozzle up to a pressure suitable for droplet-forming condition, while the pressure of gas in the sealed space is raised corresponding to the rise in pressure of the liquid to suppress ejection from the nozzle. After the pressure of the ink is raised to pressure suitable for droplet-forming condition, the sealed space is opened to the atmosphere and ink is ejected all at once.

4 Claims, 15 Drawing Sheets

LIQUID EJECTION APPARATUS AND METHOD

BACKGROUND OF THE INVENTION

1. Field of the Invention

The present invention relates to a liquid ejection apparatus and method, and more particularly, to a continuous type of liquid ejection apparatus and method.

2. Description of the Related Art

One of a continuous type of liquid ejection method involves continuously pressurizing liquid with a pump to push the liquid out from a nozzle, and vibrating the liquid with a vibration unit. In so doing, such a method creates a state wherein the liquid is regularly ejected from a nozzle as droplets. Since droplets are continuously ejected from a nozzle with this method, in the case of applying the method to an inkjet printing apparatus, it is necessary to sort the droplets used for printing (dot formation) from the droplets that are not used in accordance with data to be printed. With methods referred to as charge deflection methods, such sorting is conducted by selectively charging droplets, deflecting the droplets with an electric field, and causing the charged droplets to fly in a trajectory different from that of the non-charged droplets. Furthermore, among these methods, a method referred to as binary charge deflection method is provided with a charging electrode, a deflecting electrode, and a gutter along the droplet flight trajectory from a nozzle, such that non-charged droplets are used for printing, and charged droplets are captured and collected by the gutter.

Recently, significant improvements in printing speeds are being demanded, and for this reason improvements in droplet generation speed are being pursued along with improvements in drying speed after a droplet has landed on a print medium. For this reason, it is effective to cause droplets to be ejected and fly at high velocities, and also use highly viscous liquid (ink). Accordingly, an increase in the pressure applied to ink pushed out of a nozzle is sought. In the case of using a highly viscous ink, friction increases between the highly viscous ink and an inner wall of nozzle. This produces problems such as the following. If the pressure exerted on the ink is low, a liquid column cannot be formed instantaneously. Some of the ink stays near the nozzle outlet, which can grow to become a large ink buildup. If such ink buildup further grows in the case of a configuration that ejects ink downward, the ink buildup becomes unable to stay further in the nozzle and falls. The falling ink buildup may adhere to and stain the print medium, or it may adhere to the area around the nozzle outlet or the wall surface of a member forming the droplet flight channel and acts on droplets separated from a tip of the liquid column and influences their flight direction, which may impair print quality.

Consequently, in a continuous liquid ejection method, it is desirable to exert pressure when forming a liquid column such that the liquid ink is forcibly and instantaneously ejected from a nozzle, with this desire being stronger with higher liquid viscosities. This is because in the case where the pressure exerted on ink gradually changes until the desired ejection velocity is obtained, ejection becomes unstable in the initial stages, and problems like those described above occur.

Japanese Patent Laid-Open No. H08-258287 (1996) proposes the following technology with regard to not causing such an initial unstable state. A valve is provided between the interior space of a nozzle and an ink chamber. The valve is closed, before ink ejection is initiated, the interior space of the nozzle is emptied of ink, while the ink pressure of the ink chamber is increased such that the required ejection velocity is obtained when the valve opens and ink reaches the nozzle outlet. The value is then opened and ink is ejected in this state.

However, with the method of Japanese Patent Laid-Open No. H08-258287 (1996), ink contacts the inner wall of nozzle near where the ink is ejected from the nozzle, which causes lowered velocity. This problem of lowered velocity becomes particularly severe when using ink with a viscosity of 20 cP or more. With an ink that is not highly viscous, pressure can be corrected to compensate for the lowered velocity, but with highly viscous ink, the effects due to manufacturing inconsistencies in the inner wall of nozzle become greater, and there is an increased possibility that the ejection state will become unstable.

SUMMARY OF THE INVENTION

Consequently, it is an object of the present invention to enable a state of stable ejection and a state of stable liquid column formation to be obtained even in the initial stages, regardless of conditions such as the degree of ink viscosity.

In an aspect of the present invention, there is provided a liquid ejection apparatus comprising:

a liquid ejection head that causes liquid stored in a liquid chamber communicating with a nozzle to be ejected from the nozzle and fly as droplets;

a sealing member that seals a space including the nozzle;

a first pressurizing unit that pressurizes the inside of the space;

a second pressurizing unit that pressurizes the inside of the liquid chamber;

a valve that communicates the inside of the space with the atmosphere; and a control unit that controls the sealing member, the first pressurizing unit, the second pressurizing unit, and the valve, the control unit, in a state wherein the sealing member has sealed the space and the valve is closed, controlling to increase the pressure of gas inside the space by means of the first pressurizing unit and also increase the pressure of liquid inside the liquid chamber by means of the second pressurizing unit while maintaining the pressure of the gas inside the space equal to or greater than the pressure of the liquid inside the liquid chamber, and then the control unit controlling to return the pressure of the gas inside the space to atmospheric pressure by opening the valve, such that ejection of liquid from the nozzle is initiated.

In another aspect of the present invention, there is provided a liquid ejection method executed by a liquid ejection apparatus having a liquid ejection head that causes liquid stored in a liquid chamber communicating with a nozzle to be ejected from the nozzle and fly as droplets and a sealing member that seals a space including the nozzle, the liquid ejection method comprising the steps of:

increasing the pressure of gas inside the space and also increasing the pressure of liquid inside the liquid chamber while keeping the pressure of the gas inside the space equal to or greater than the pressure of the liquid inside the liquid chamber, in a state wherein the sealing member has sealed the space; and returning the pressure of the gas inside the space to atmospheric pressure and initiating ejection of liquid from the nozzle.

According to the present invention, ink can be instantaneously ejected in a state where suitable pressure is exerted on the ink. For this reason, a favorable liquid column can be immediately formed regardless of conditions such as the ink viscosity, nozzle shape/dimensions, and ambient conditions, and without undergoing a state wherein some ink stays near the nozzle outlet or grows to become a large ink buildup. In so doing, it also becomes possible to shorten the time required by initialization operations that precede printing operations. Furthermore, these advantages can be realized even in the case where a print head with a large number of nozzles is used. This is because by providing a common liquid chamber communicating with the respective nozzles and disposing the respective nozzles so as to commonly communicate with the chamber, it is sufficient to provide a cap that forms a sealed space such that all of the respective droplet flight spaces connected to the respective nozzles communicate with the sealed space.

Further features of the present invention will become apparent from the following description of exemplary embodiments (with reference to the attached drawings).

DESCRIPTION OF THE EMBODIMENTS

Hereinafter, embodiments of the present invention will be described in detail and with reference to the drawings. The description hereinafter describes the case of applying the present invention to an inkjet printing apparatus that prints onto a print medium by ejecting ink having color material components thereon. However, the present invention can be widely applied to continuous liquid ejection apparatus.

Herein, "liquid" in the present invention refers to a liquid that, by application onto a print medium, may be used in conjunction with the formation of images, designs, patterns, etc. or treatment of a print medium, or with ink processing (for example, the coagulation or encapsulation of pigments in ink applied to a print medium). Also, such "application" of liquid does not only include the case of application with the intent to form text, graphics, or other intentional information. In other words, "application" also widely refers to cases of forming images, designs, patterns, etc. onto a medium or processing a medium, regardless of whether the application is intentional or unintentional, and regardless of whether or not the application is an actualization of matter that is visible and perceivable by human beings. Furthermore, the "medium" subjected to such application refers to not only paper used in typical printing apparatus, but also widely refers to materials able to receive liquid, such as cloth, plastic film, metal sheets, glass, ceramics, wooden materials, leather, etc.

(First Embodiment)

Figure 1:
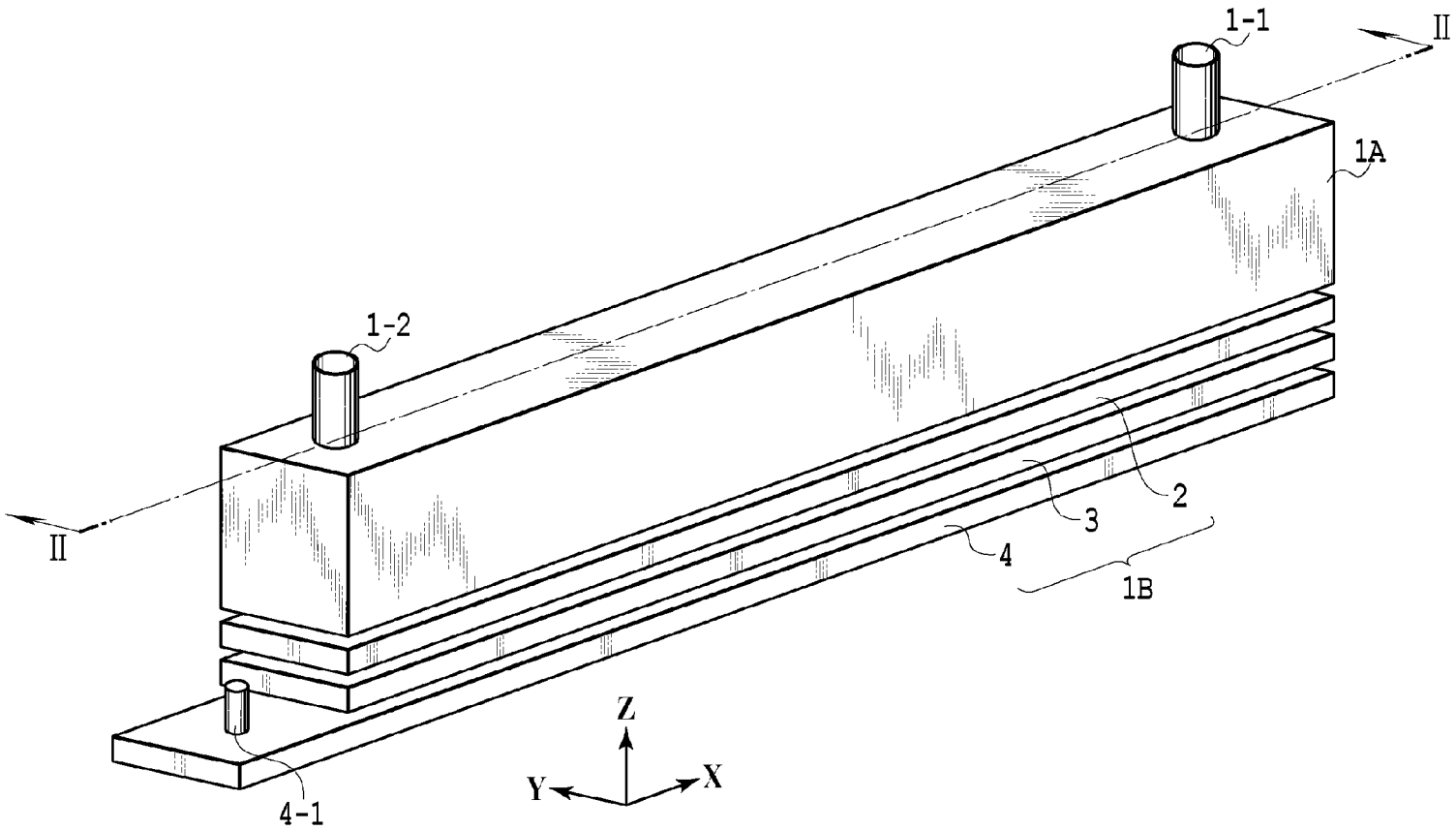
FIG. 1 is a schematic perspective view illustrating an inkjet print head applied to an inkjet printing apparatus in accordance with a first embodiment of the present invention.
Figure 2:
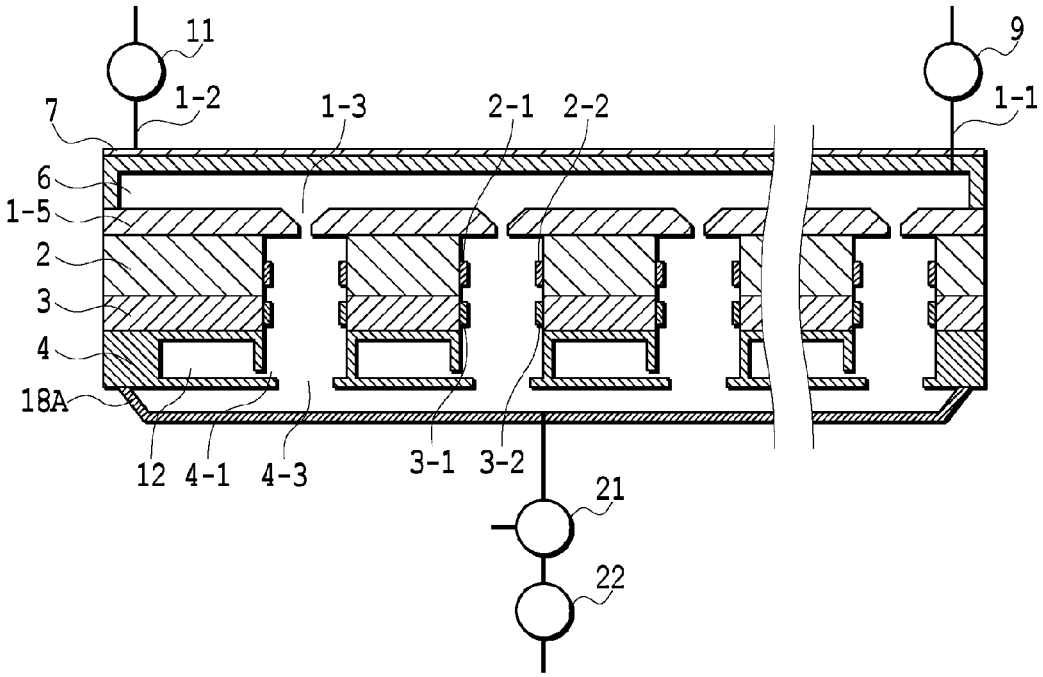
FIG. 2 is a schematic cross-section view of the area around nozzles along the longitudinal direction of the inkjet print head in FIG. 1.

FIG. 1 is a schematic perspective view illustrating an inkjet print head (hereinafter also simply referred to as a head) applied to an inkjet printing apparatus (hereinafter also simply referred to as a printing apparatus) in accordance with a first embodiment of the present invention. FIG. 2 is a schematic cross-section view of the area around nozzles along the longitudinal direction of the inkjet print head in FIG. 1. The head of the present embodiment has a configuration which is a so-called a line head, wherein a plurality of nozzles 1-3 and corresponding droplet outlets 4-3 are arrayed along the widthwise direction of a print medium to be printed upon and across a range corresponding to the full width of the print medium. Additionally, the head is installed in a printing apparatus in a state where the nozzles are facing downward, and printing is performed by applying liquid (hereinafter also referred to as ink) as droplets (liquid droplets) to a print medium passing under the arrayed range of droplet outlets.

The head is provided with an upper unit 1A, and a lower unit 1B made up of a charging unit 2, a deflecting unit 3, and a collecting unit 4 in a stacked state. An inflow unit 1-2 that forms an inflow channel for causing ink to flow into a common liquid chamber 6 from an ink supply source and an outflow unit 1-1 that forms an outflow channel for causing ink to flow out from the common liquid chamber 6 and return to the ink reservoir for example, are connected to the upper unit 1A. As shown in FIG. 2, in the charging unit 2, the deflecting unit 3, and the collecting unit 4 of the lower unit 1B, there is formed a path which defines a cylindrical space extending from the nozzle 1-3 to the droplet outlet 4-3 facing a print medium (not shown). Additionally, a liquid column projects into this space from the nozzle 1-3, and ink droplets that have separated from this liquid column fly. Also, charging electrodes 2-1 and 2-2 of the charging unit 2, deflecting electrodes 3-1 and 3-2 of the deflecting unit 3, and a collection opening 4-1 of the collecting unit 4 are disposed facing into this cylindrical space. To the head, a cap 18A as a sealing member can be joined which can define a sealed space by closely attaching to the area around the range in which droplet outlets are disposed. This cap 18A is movable between a position that takes the sealed state (hereinafter referred to as the capped state) and a standby position apart from the capping position so as not to interfere with printing operations.

Figure 3:
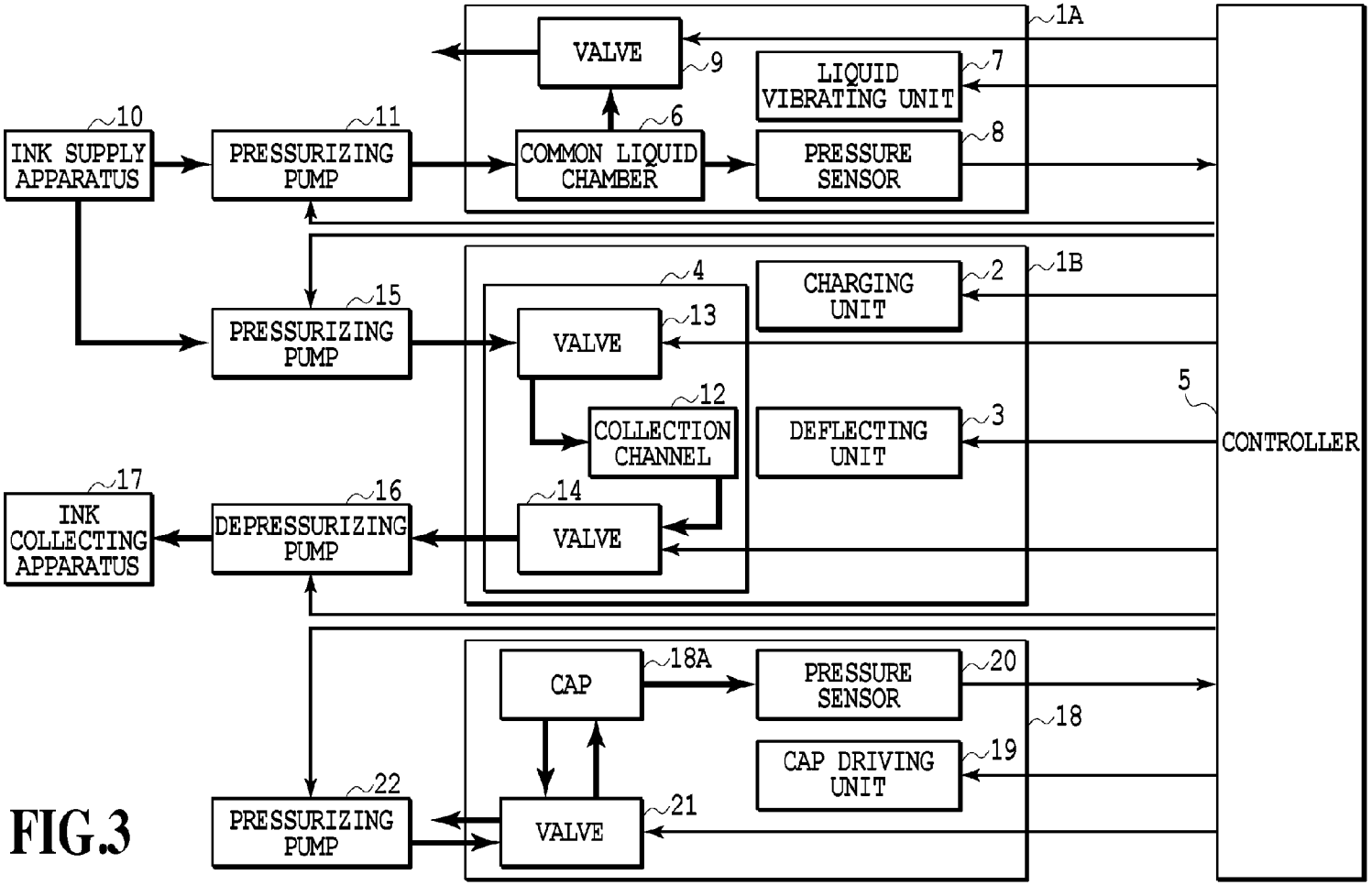
FIG. 3 is a block diagram for explaining a configuration of an ink system and a control system in the printing apparatus in accordance with the first embodiment.

FIG. 3 is a block diagram for explaining a configuration of an ink system and a control system in a printing apparatus in accordance with the present embodiment. In FIG. 3, arrows drawn with thick solid lines indicate flows of ink or other fluids, whereas arrows drawn with thin solid lines indicate flows of control signals.

Reference numeral 5 denotes a controller, which includes a CPU that controls the apparatus overall in accordance with processing sequences, etc. described later, a ROM storing programs corresponding to such processing sequences, and a RAM used as a work area, for example. The upper unit 1A includes the common liquid chamber 6, a liquid vibrating unit 7, a pressure sensor 8, and a valve 9. Ink is supplied to the common liquid chamber 6 from an ink supply apparatus 10 that acts as an ink supply source by means of a pressurizing pump 11 that acts as a liquid pressurizing unit (a second pressuring unit) and the ink thus supplied is retained in the common liquid chamber 6. As described later, nozzles are disposed on an orifice plate 1-5 (FIG. 2) that forms a bottom of the common liquid chamber 6. The liquid vibrating unit 7 induces vibration in the ink inside the common liquid chamber 6 to achieve droplet formation, and performs vibration operations according to instructions from the controller 5. The pressure sensor 8 measures the pressure of ink inside the common liquid chamber, and notifies this information to the controllers. The valve 9 operates according to instructions from the controller 5. When ink supply to the common liquid chamber 6 is initiated, the valve 9 opens the outflow unit 1-1 and causes the common liquid chamber 6 to communicate with the atmosphere. In contrast, when ink supply ends, the valve 9 closes the outflow unit 1-1.

Figure 4:
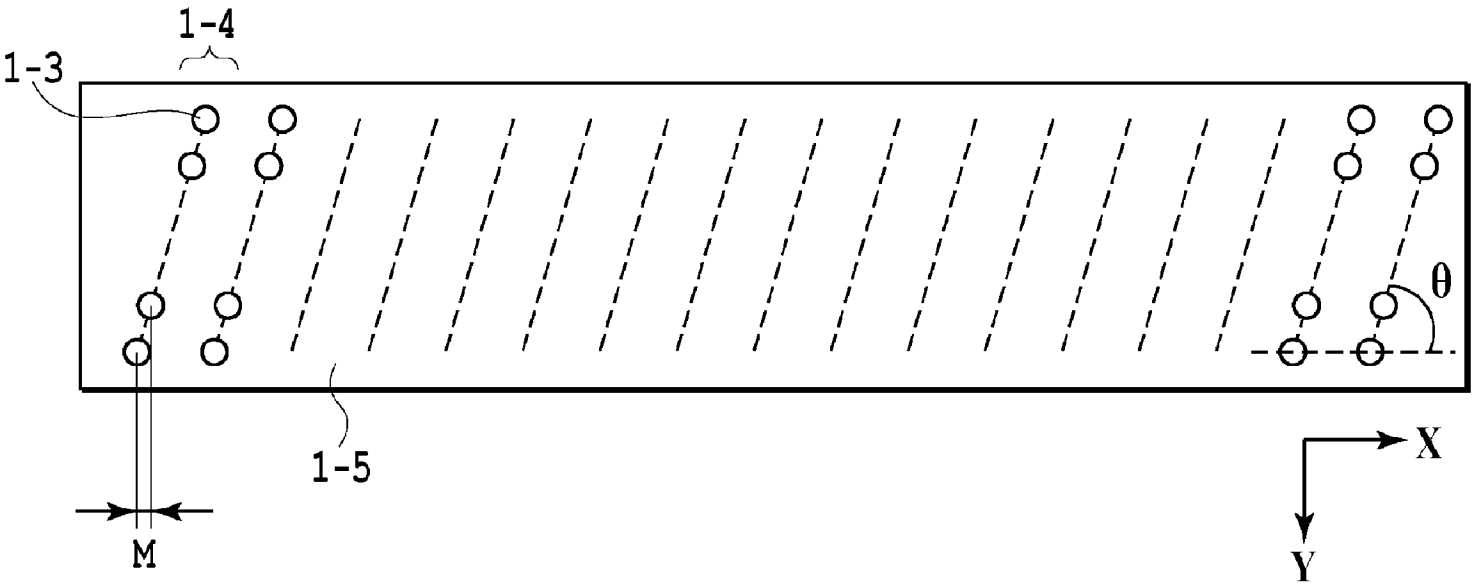
FIG. 4 is a plan view as viewed from below (the Z direction in FIG. 1) the inkjet printing head in FIG. 1.

FIG. 4 is a plan view of the orifice plate 1-5 upon which nozzles 1-3 are formed, as viewed from below (the Z direction in FIG. 1). Respective nozzle outlets are fine holes with a diameter of approximately 10 μm. In this example, a plurality of the nozzles 1-3 is disposed to form one nozzle array 1-4, with each adjacent nozzle being positioned diagonally at an angle θ. Additionally, a plurality of the nozzle array 1-4 is disposed in the X direction. Also, the distance (M) in the X direction between adjacent nozzles on respective nozzle arrays is set to be a distance that corresponds to the output resolution of the printing apparatus.

Referring again to FIG. 3, the charging unit 2 operates in the area where droplets are generated from a liquid column, and selectively applies a charge to each droplet. In other words, the charging unit 2 operates according to data to be printed on a print medium, so as not to apply a charge to a droplet used for printing (hereinafter also referred to as a print droplet), and so as to apply a charge to a droplet not used for printing (hereinafter also referred to as a non-print droplet). The deflecting unit 3 operates to deflect the non-print droplets using an electric field. Whereas the print droplets fly straight towards a print medium, the deflected non-print droplets are received at the collection opening 4-1 of the collecting unit 4. The collection opening 4-1 is configured by collectively disposing a plurality of fine holes each having a diameter of approximately 10 μm, for example. As clear from FIG. 2, a plurality of the collection opening 4-1 is provided in correspondence with each of the plurality of nozzles 1-3. Also, in the collecting unit 4 in this example, the channels from the plurality of collection openings 4-1 join together to form a single collection channel. By operating a single depressurizing pump 16 for collection that is joined to this collection channel, ink received at all collection openings 4-1 is collectively suctioned and collected.

The collecting unit 4 includes a collection channel 12, a channel-switching valve 13 disposed at the inlet side (i.e., upstream side) thereof, and a channel-opening/closing valve 14 disposed at the outlet side (i.e., downstream side). During a preparatory stage before printing operations, the collection channel 12 is filled with ink. This is conducted by switching the valve 13 to connect the collection channel 12 to a pressurizing pump 15, and driving the pressurizing pump 15 to introduce ink from the ink supply apparatus 10 to the collection channel 12. During ink collection, the valve 13 is switched to connect the collection channel 12 to the collection openings 4-1 while the valve 14 is opened, and a depressurizing pump 16 is driven to transfer ink from the collection channel 12 to an ink collecting apparatus 17. Ink collected by the ink collecting apparatus 17 can be reused by conducting foreign particle removal and viscosity adjustment, and then transferring back to the ink to the ink supply apparatus 10, for example.

Reference numeral 18 denotes a cap apparatus that includes the above-described cap 18A, a driving unit 19 for the cap 18A, a pressure sensor 20, and a valve 21. The cap driving unit 19 is able to drive the cap 18A so as to move it between the capping position and the standby position. The pressure sensor 20 is used in order to detect pressure inside the sealed space formed by the joining of the cap 18A, and values thus detected are sent to the controller 5. The valve 21 operates to switch the space formed by the joining of the cap 18A between communication with a pressurizing pump 22 (a first pressurizing unit) and with the outside air. In other words, the valve 21 may be switched over to the pressurizing pump 22 in the capped state of the cap 18A, and the pressurizing pump 22 may be driven to pump in air. In so doing, pressure inside the sealed space can be increased. In contrast, the sealed state can be released by switching the valve 21 over to the atmosphere. In other words, in the present embodiment, the pressurizing pump 22 and the valve 21 function as a gas pressure adjustment unit.

Figure 5:
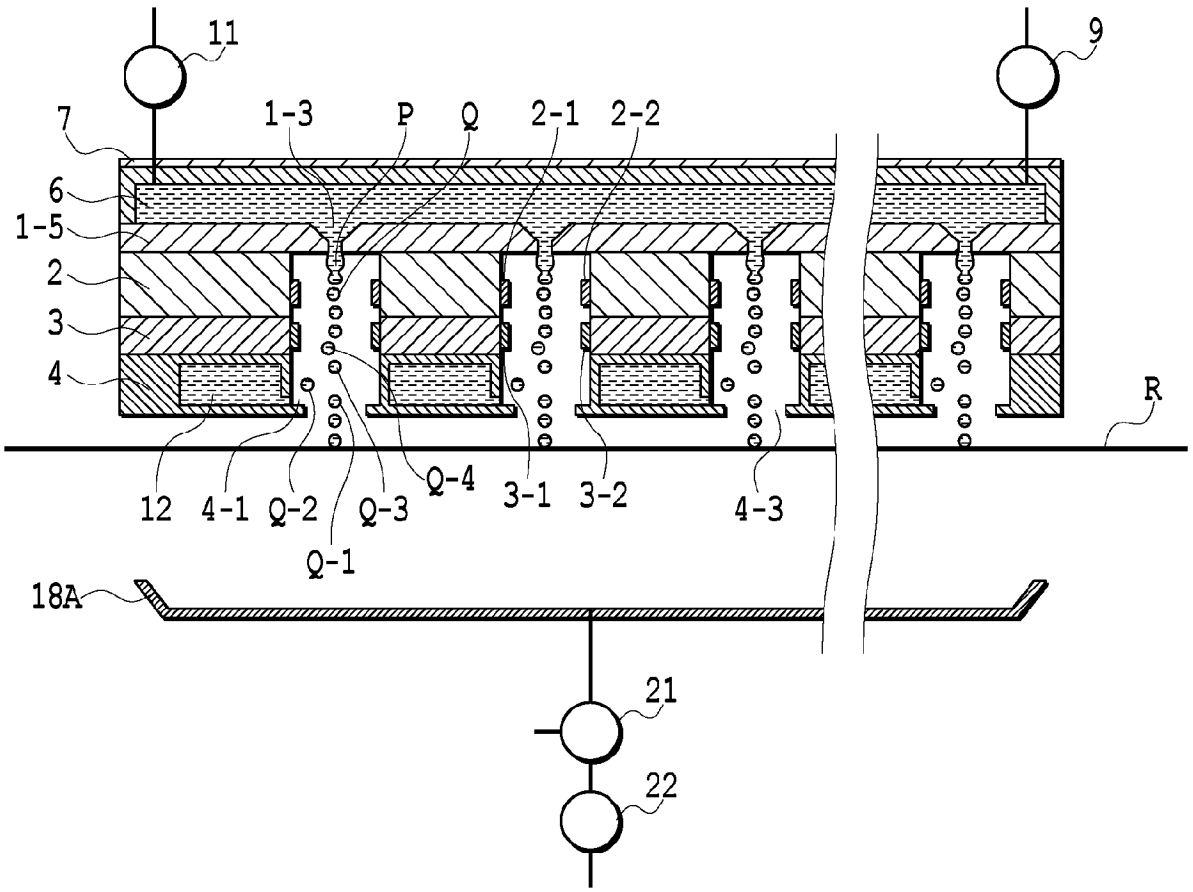
FIG. 5 is a schematic cross-section view of the area around nozzles during printing operations of the inkjet print head in FIG. 1.

FIG. 5 is a schematic cross-section view of the area around nozzles during printing operations. By applying a pressure of approximately 1 MPa (gauge pressure) to ink inside the common liquid chamber 6 by the pressurizing pump 11, ink is continuously ejected from the respective ejection nozzles 1-3, and a liquid column P is formed. Furthermore, By vibrating the whole ink inside the common liquid chamber 6 by the vibration operations of the liquid vibrating unit 7, fine droplets Q successively separate from the tip of the liquid column P, and the droplets successively fly at a constant velocity and at constant intervals. Herein, the tip of the liquid column P is formed at a position influenced by the operation of the charging electrodes 2-1 and 2-2 of the charging unit 2.

The voltage applied to the charging electrodes 2-1 and 2-2 is controlled on the basis of print data for image formation. In other words, assume that a voltage is not applied to the charging electrodes when print droplets (Q-1, Q-3) are separated from the liquid column P, and thus print droplets are not charged. In contrast, assume that a positive voltage is applied to the charging electrodes 2-1 and 2-2 when non-print droplets are separated from the liquid column P. Thus, since a current flows through the ink itself that forms the liquid column P, the surface of the liquid column P takes on charge of opposite polarity to the charging electrodes (i.e., negative charge), and droplets are separated from the liquid column P in this state. These separated droplets fly as negatively-charged non-print droplets (Q-2, Q-4).

In the deflecting unit 3, the deflecting electrode 3-1 is taken to have a potential of 0 V, whereas a negative voltage is applied to the deflecting electrode 3-2. Consequently, the flight direction of an ejected droplet is determined according to whether or not the droplet is influenced by the electric field produced by the deflecting electrodes. For example, when the print droplet Q-1 passes between the deflecting electrode pair, the print droplet Q-1 is not influenced by the electric field because it carries no charge, and thus flies straight towards a print medium R without its flight direction being deflected. In contrast, a non-print droplet Q-2 carrying a negative charge is influenced by the electric field, deflected in a direction towards a collection opening 4-1, and collected in the collection channel 12 via the collection opening 4-1.

Figure 6:
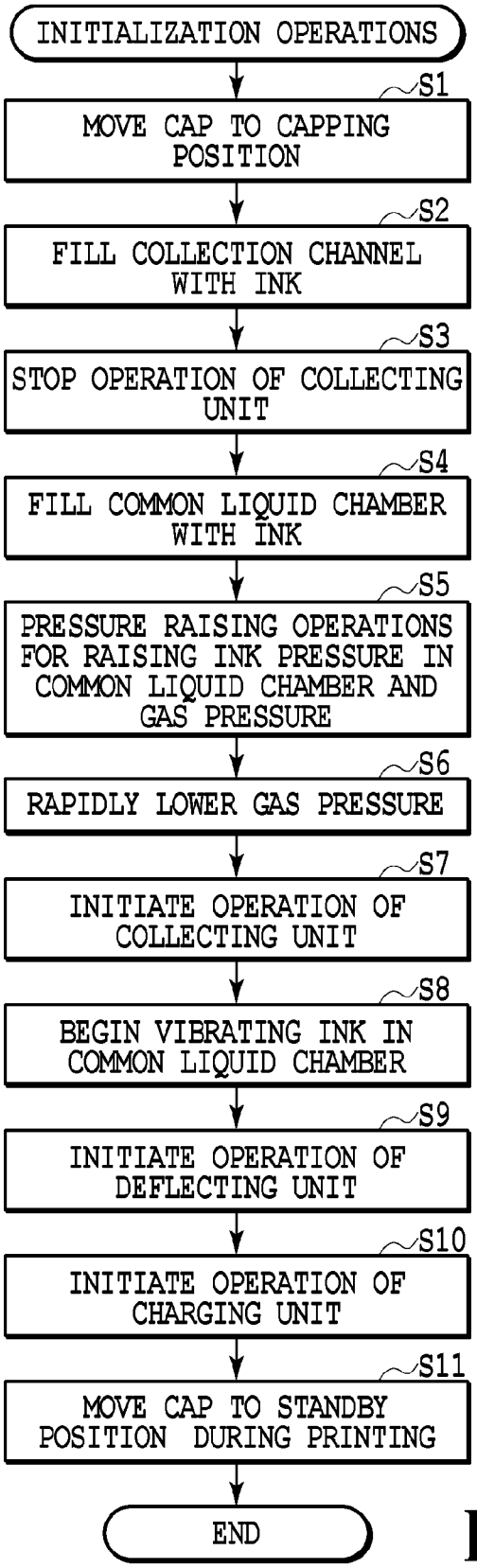
FIG. 6 is a flowchart illustrating one example of an initialization control sequence for the inkjet printing apparatus conducted prior to printing operations in the first embodiment.

FIG. 6 is a flowchart illustrating one example of an inkjet printing apparatus initialization control sequence conducted prior to printing operations in the present embodiment. The sequence herein is conducted in accordance with instructions from the controller 5. More specifically, the sequence is conducted as a result of the CPU provided in the controller 5 controlling respective units in accordance with a program stored in the ROM.

First, in step S1, the cap driving unit 19 is made to operate so as to move the cap 18A to the capping position, thereby causing the cap 18A to join with the area around the range in which the droplet outlets 4-3 are arrayed. In so doing, the space (the droplet flight space) extending from a nozzle 1-3 to droplet outlet 4-3 becomes a sealed space. In step S2, the valves 13 and 14 are put into an open state and the pressurizing pump 15 is operated, thereby introducing ink from the ink supply apparatus 10 into the collection channel 12. Next, by closing the valves 13 and 14 in step S3, a state is achieved wherein ink inside the collection channel 12 does not flow (i.e., a state wherein operation of the collecting unit has stopped).

In step S4, the pressurizing pump 11 is operated, and the common liquid chamber 6 is filled with ink from the ink supply apparatus 10. At this time, the pressure produced by the pressurizing pump 11 is limited to a value such that ink does not leave the nozzle facing the droplet flight space in the sealed state. Herein, the valve 9 is controlled so as to be opened when ink filling starts, and closed when filling ends.

Next, in step S5, the pressurizing pump 11 is operated to increase the pressure of the ink inside the common liquid chamber 6 up to a pressure whereby liquid column formation can be conducted, by a pressure control described later using FIG. 5. Meanwhile, the pressurizing pump 22 is also operated to increase the gas pressure inside the droplet flight space in the sealed state. In step S6, the valve 21 is switched over to the atmosphere. In so doing, the pressure inside the droplet flight space becomes equal to atmospheric pressure, while the ink in the common liquid chamber 6 enters a pressurized state higher than the atmospheric pressure. For this reason, ink is ejected from the nozzle 1-3 with sufficient velocity, and a liquid column is immediately formed. In step S7, the valve 14 is opened to connect the collection channel 12 with the depressurizing pump 16. By means of this operation, the collecting unit 4 is made to operate.

In step S8, the liquid vibrating unit 7 begins operation. In so doing, ink is vibrated, and droplets are generated from the liquid column. In step S9, the deflecting unit 3 begins operation, and in step S10, the charging unit 2 begins operation. In so doing, all generated droplets are charged, and thus all droplets are deflected towards the collecting unit 4 by the deflecting unit 3 and received at the collection opening 4-1. By operating the cap driving unit 19 in step S11 while in this state, the cap 18A can be moved to the standby position during printing. The initialization operations conducted prior to printing then completed.

Figure 7:
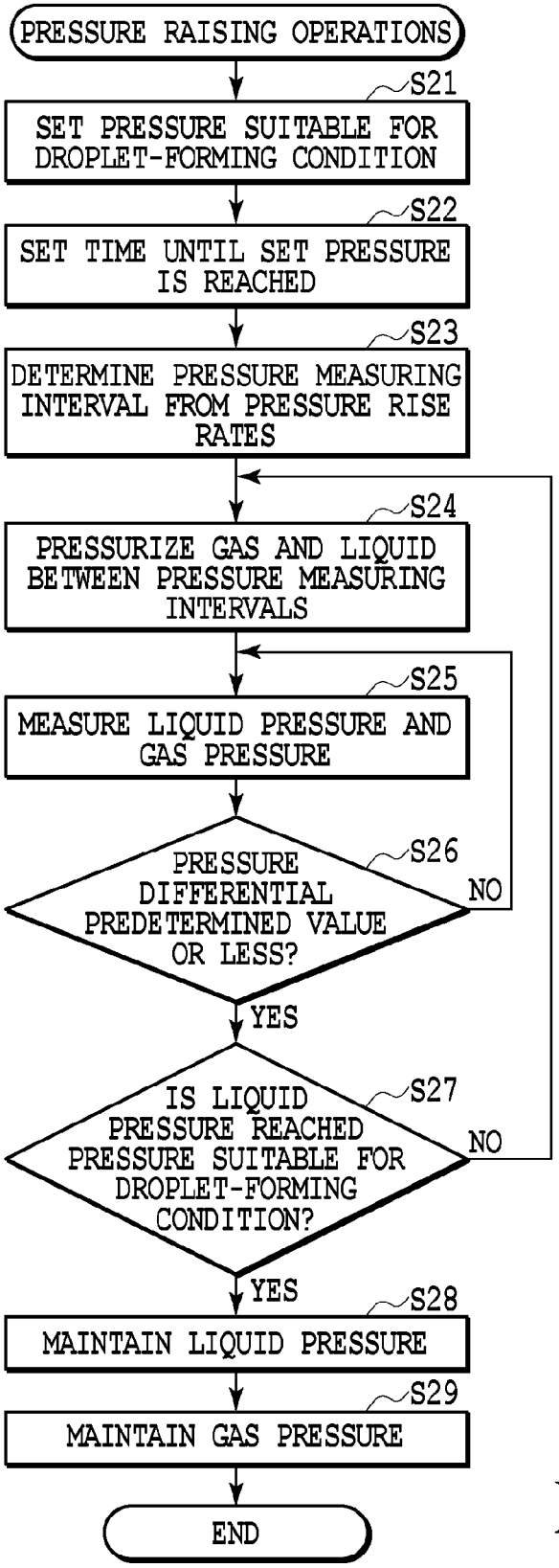
FIG. 7 is a flowchart illustrating details of a pressure control sequence conducted during the process in FIG. 6.

Details of the pressure control conducted in step S5 will now be described with reference to FIG. 7. In step S21, pressure conditions are set for ink inside the common liquid chamber 6 in order to generate droplets. The pressure conditions are set on the basis of conditions such as the ink viscosity, nozzle shape/dimensions, and ambient conditions. Meanwhile, gas pressure conditions are set for air inside the droplet flight space. The gas pressure conditions are substantially equivalent to the ink pressure conditions. In step S22, an amount of time is set until the set pressures are reached. In step S23, timing intervals for performing pressure measurements are determined from the respective pressure rise rates in order to prevent the pressure differential due to the time difference between the pressure rise rates from becoming greater than the pressure differential at which the nozzle meniscus is kept. In step S24, the pressurizing pumps 22 and 11 are operated between these intervals, and the gas pressure inside the droplet flight space and the ink pressure inside the common liquid chamber 6 are respectively increased. In step S25, when the pressure measurement timings defined in step S23 are reached, the value for the gas pressure inside the droplet flight space measured by the pressure sensor 20 and the value for the ink pressure inside the common liquid chamber 6 measured by the pressure sensor 8 are sent to the controller 5. In step S26, the pressures are compared, and it is determined whether or not their differential is less than or equal to a predetermined value. The process returns to step S25 in the case of a negative determination, and proceeds to step S27 in the case of a positive determination. In step S27, it is determined whether or not the liquid pressure has reached a suitable pressure (a pressure suitable for droplet-forming condition) established on the basis of various conditions such as the ink viscosity, nozzle shape/dimensions, and ambient conditions. The process returns to step S24 in the case of a negative determination, and the processing thereafter is repeated. In contrast, the process proceeds to step S28 in the case of a positive determination, and the pressurizing pump 11 is controlled so as to maintain the ink pressure at that point. Furthermore, in step S29 the pressurizing pump 22 also controlled so as to maintain the gas pressure. In this way, both air and ink are put into states maintaining predetermined pressures, and this sequence corresponding to step S5 in FIG. 6 is completed.

Figure 8:
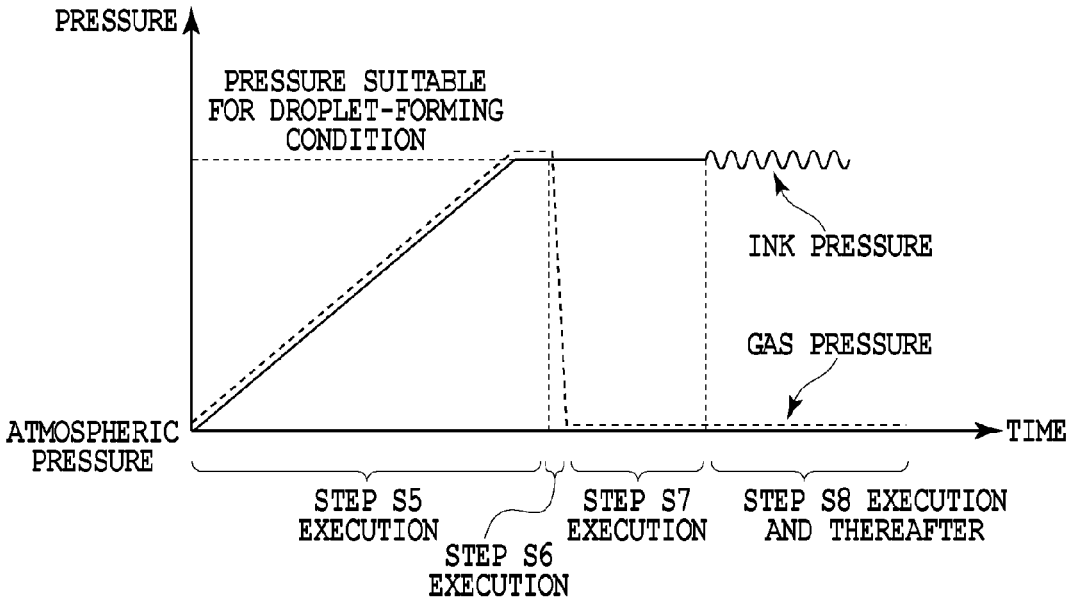
FIG. 8 is a graph illustrating change over time of ink pressure inside a common liquid chamber and gas pressure inside a droplet flight space when executing the process in FIG. 6.

FIG. 8 is a graph illustrating change over time of ink pressure inside the common liquid chamber 6 (solid line) and gas pressure inside the droplet flight space (broken line) in and after step S5. By executing step S5 (FIG. 7), both the ink pressure and the gas pressure increase. When this process ends, the inside of the common liquid chamber 6 is maintained at an ink pressure condition enabling droplets to be generated (the pressure suitable for droplet-forming condition), while the inside of the droplet flight space is maintained at a pressure nearly equivalent to the pressure suitable for droplet-forming condition. In other words, the ejection of ink from the nozzle 1-3 (i.e., formation of the liquid column) does not occur in this state.

By subsequently switching the valve 21 over to the atmosphere with the processing in step S6, the pressure inside the droplet flight space rapidly drops and equalizes with atmospheric pressure. Since the ink in the common liquid chamber 6 is at the pressure suitable for droplet-forming condition, which is higher than the atmospheric pressure, ink is ejected from a nozzle 1-3 with sufficient velocity when step S7 is executed, and a liquid column is immediately formed. Thereafter, the ink is vibrated due to the liquid vibrating unit 7 beginning to operate, and droplets are generated from the liquid column.

According to the present embodiment, ink can be instantaneously ejected in a state where suitable pressure is exerted on the ink, the suitable pressure being established on the basis of conditions such as the ink viscosity, nozzle shape/dimensions, and ambient conditions. For this reason, a favorable liquid column can be immediately formed regardless of conditions such as the degree of ink viscosity, for example, and without undergoing a state wherein some ink stays near the nozzle outlet or grows to become a large ink buildup. In so doing, droplets are stably formed and fly even in the initial stages, and the droplets are also all reliably collected while the cap 18A is moved to the standby position. Additionally, it also becomes possible to shorten the time required by initialization operations that precede printing operations.

Furthermore, in the present embodiment, these advantages can be achieved even for a large number of nozzles. In other words, a common liquid chamber communicating with respective nozzles is provided, and if pressure is respectively applied to each nozzle, a uniform pressure suitable for droplet-forming condition can be exerted on the ink in each nozzle. Meanwhile, since the sealed space formed by the joining of the cap 18A is a common space communicating with all of droplet flight spaces that communicate with respective nozzles, a uniform pressure can be exerted on all droplet flight spaces. Additionally, by conducting the above control, ink can be instantaneously and concurrently ejected from the respective nozzles in a state where a suitable pressure is exerted on the ink in each nozzle. Consequently, a favorable liquid column can be immediately formed in every nozzle, without undergoing a state wherein some ink stays near the nozzle outlet or grows to become a large ink buildup.

(Second Embodiment)

Next, a second embodiment of the present invention will be described. Herein, in the drawings referenced in the course of the following description, like reference symbols are given at corresponding portions for respective units configured similarly to those of the above first embodiment. The present embodiment also basically adopts the head illustrated in FIG. 1.

Figure 9:
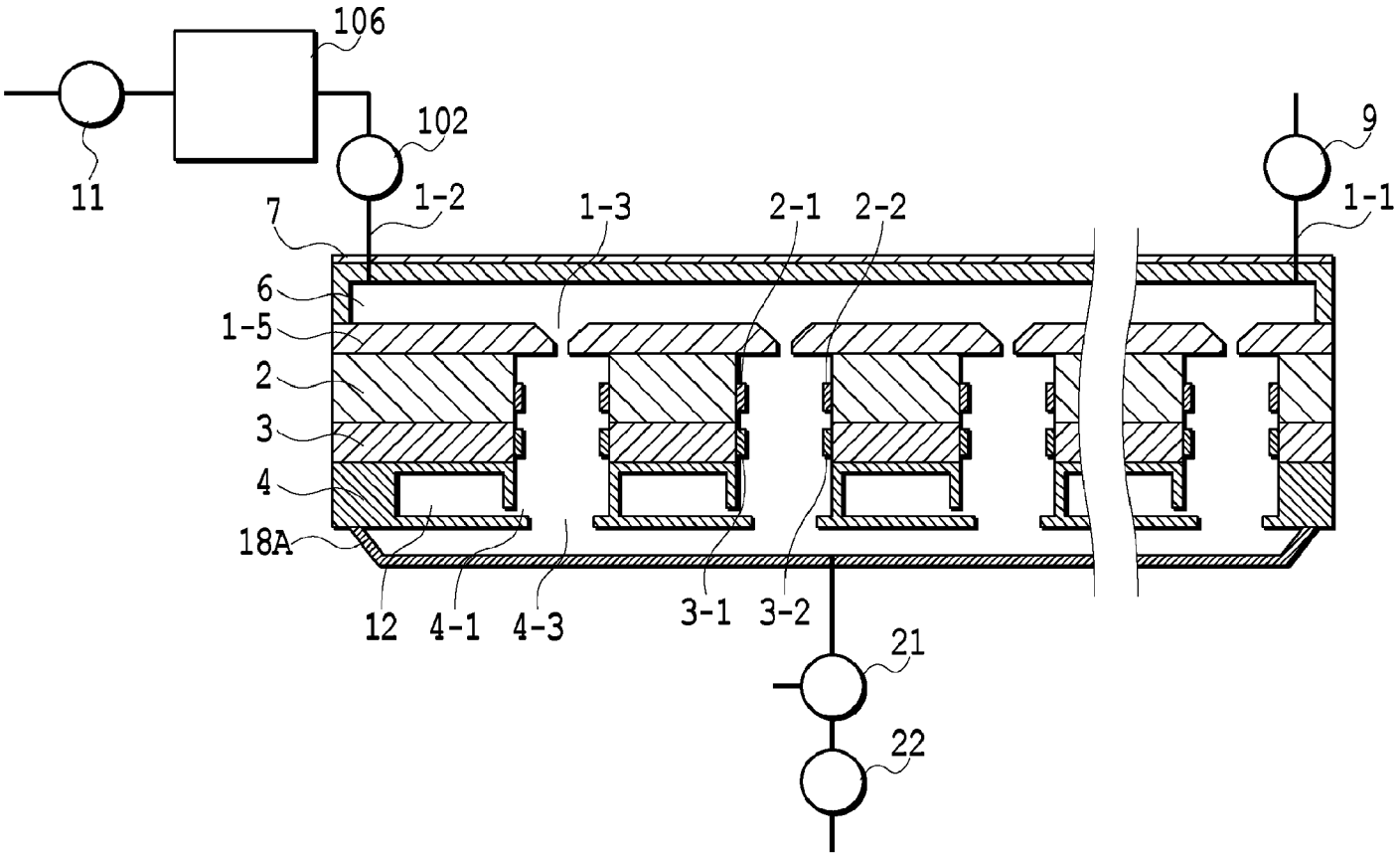
FIG. 9 is a schematic cross-section view illustrating a configuration around nozzles along the longitudinal direction of a print head in order to explain the principal part of a second embodiment of the present invention.

FIG. 9 is a schematic cross-section view illustrating the principal part of the present embodiment using such a head. The present embodiment differs from the first embodiment in that a pump-side liquid chamber 106 (second liquid chamber) and an on-off valve 102 are inserted between the pressurizing pump 11 and the common liquid chamber 6 with respect to the inflow unit 1-2 that forms an inflow channel for causing ink to flow into the common liquid chamber 6 from an ink supply source.

Figure 10:
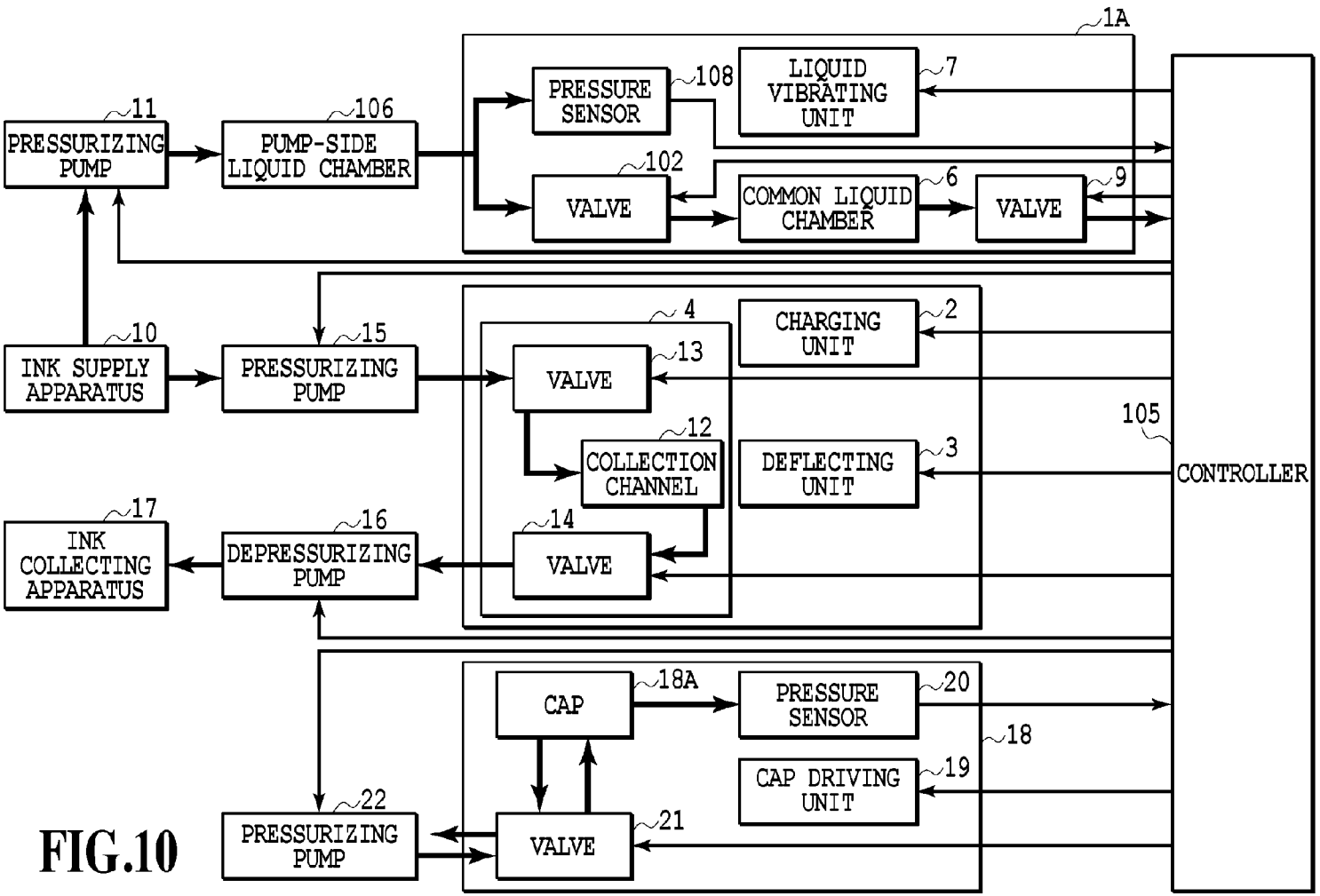
FIG. 10 is a block diagram for explaining a configuration of an ink system and a control system in a printing apparatus in accordance with a second embodiment.

FIG. 10 is a block diagram for explaining a configuration of an ink system and a control system in a printing apparatus in accordance with the present embodiment. Similarly to FIG. 3, arrows drawn with thick solid lines indicate flows of ink or other fluids, whereas arrows drawn with thin solid lines indicate flows of control signals. The configuration related to the collecting unit 4 and the cap apparatus 18 is similar to FIG. 3. However, in the present embodiment, the configuration related to the upper unit 1A is provided with a pump-side liquid chamber 106 for storing ink supplied from the ink supply apparatus 10 by the pressurizing pump 11. Also, in addition to the common liquid chamber 6, the liquid vibrating unit 7, and the valve 9, the upper unit 1A in accordance with the present embodiment is provided with a valve 102 for opening/closing the ink inflow channel into the common liquid chamber 6, and a pressure sensor 108 that measures the pressure of ink inside the pump-side liquid chamber 106. Additionally, measurement results related to the pressure of ink inside the pump-side liquid chamber 106 that is measured by the pressure sensor 108 are sent to the controller 5, while the valve 102 opens and closes according to instructions from the controller 5. In other words, by closing the valve 102, it is possible to pressure ink inside the pump-side liquid chamber 106 independently of the common liquid chamber 6. Meanwhile, by opening the valve 102, it is possible to make the pump-side liquid chamber 106 and the common liquid chamber 6 communicate with each other and equalize pressure.

Figure 11:
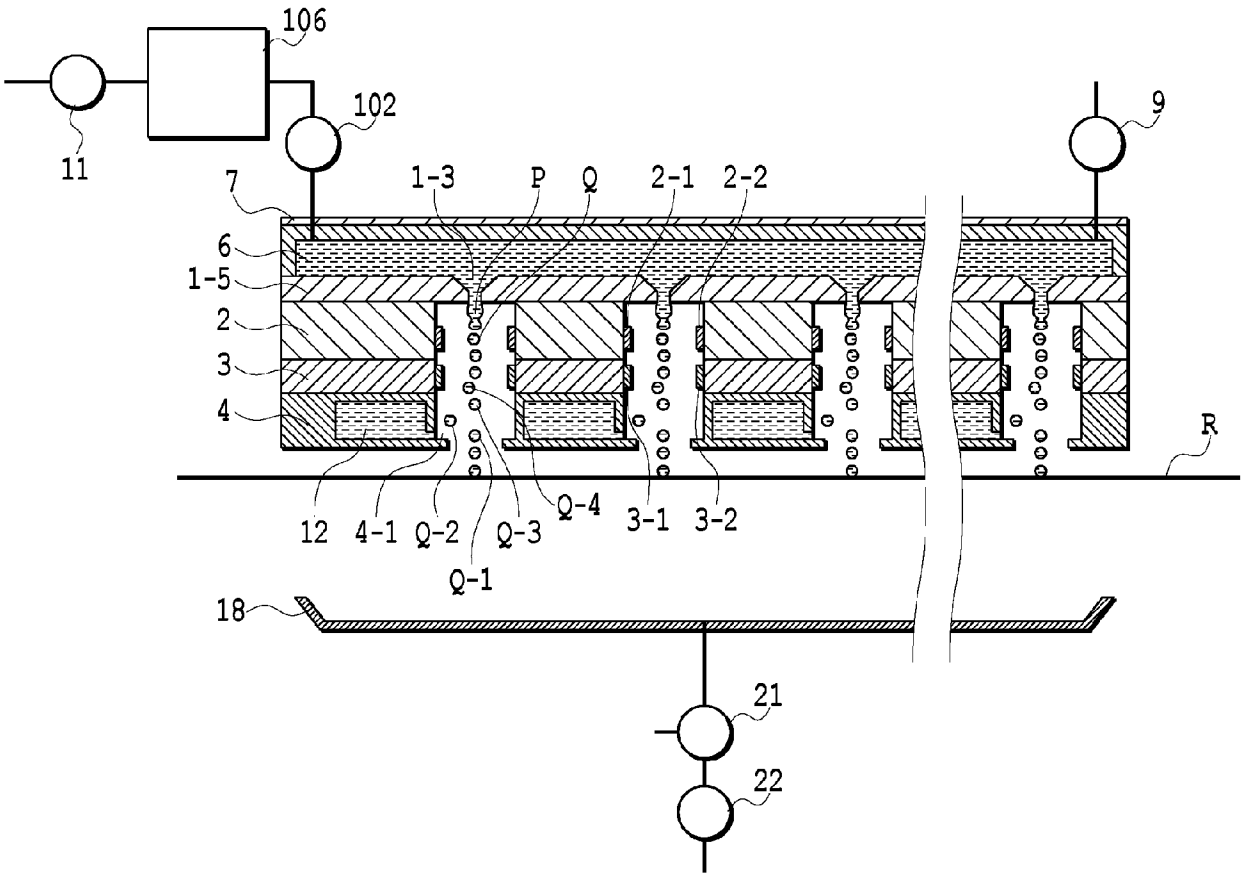
FIG. 11 is a schematic cross-section view of the area around nozzles during printing operations of the inkjet print head in accordance with the second embodiment.

FIG. 11 is a schematic cross-section view of the area around nozzles during printing operations. In the present embodiment, when conducting printing operations, a pressure of approximately 1 MPa (gauge pressure) is applied to ink inside the pump-side liquid chamber 106 and inside the common liquid chamber 6 by the pressurizing pump 11. In so doing, ink is continuously ejected from each ejection nozzle 1-3, and a liquid column P is formed. Subsequent operations, such as the vibration operations on the whole ink inside the common liquid chamber 6 by the liquid vibrating unit 7 and the resulting separation of droplets Q, the driving manner of the charging unit 2 and the deflecting unit 3 based on print data, the flight of print droplets towards a print medium R, and the non-print droplet collection operations by the collecting unit 4, are similar to the above embodiment.

Figure 12:
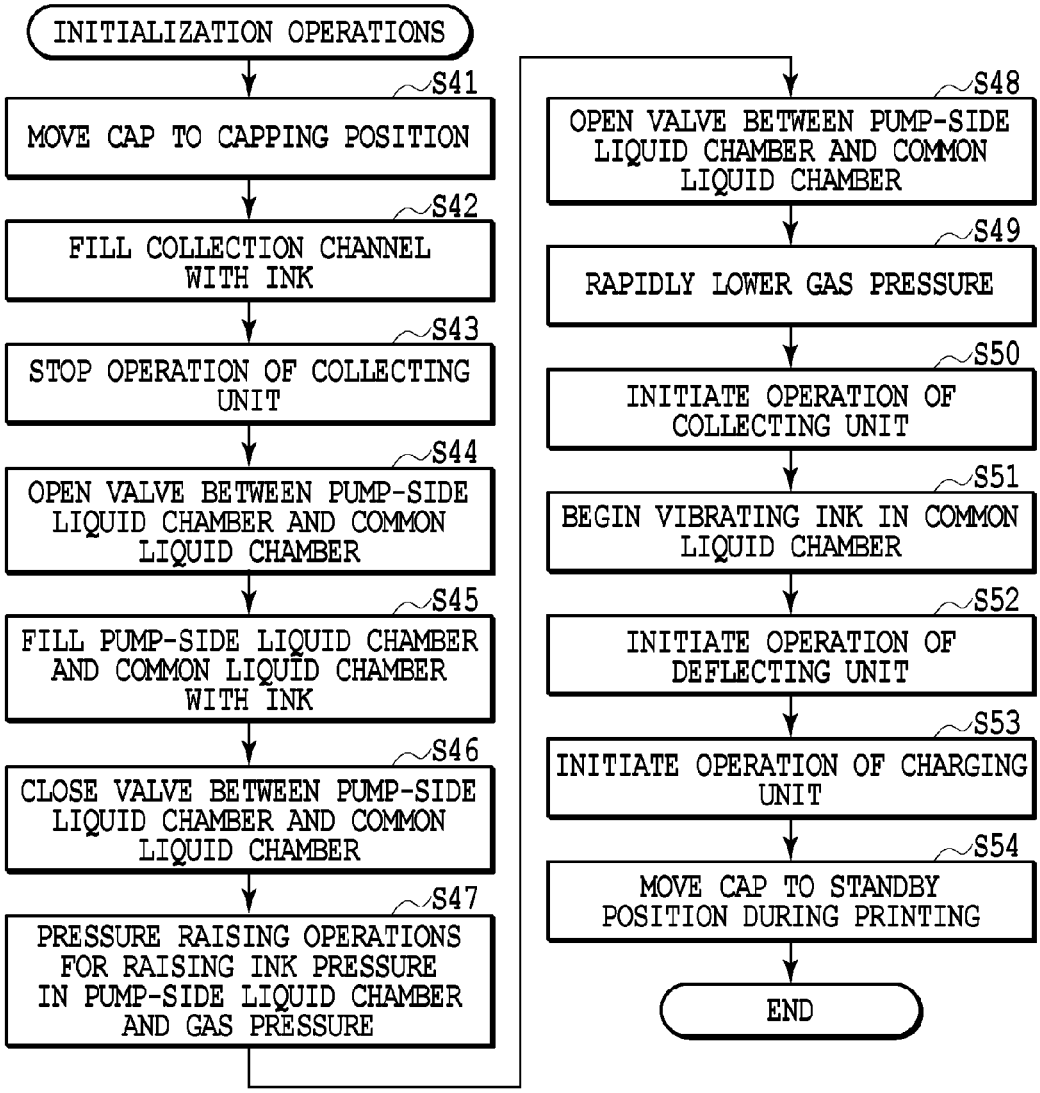
FIG. 12 is a flowchart illustrating one example of an initialization control sequence for the inkjet printing apparatus conducted prior to printing operations in the second embodiment.

FIG. 12 illustrates an example of an inkjet printing apparatus initialization control sequence conducted prior to printing operations in the present embodiment. Herein, the processing in steps S41, S42, and S43 are respectively similar to the processing in steps S1, S2, and S3 in FIG. 6.

In step S44, the valve 102 is opened while in a state where ink inside the collection channel 12 cannot flow (i.e., a state wherein operation of the collecting unit has stopped). In so doing, the pump-side liquid chamber 106 is communicated with the common liquid chamber 6. In step S45, the pressurizing pump 11 is operated, and the pump-side liquid chamber 106 and the common liquid chamber 6 are filled with ink from the ink supply apparatus 10. At this time, the pressure produced by the pressurizing pump 11 is limited to a value such that ink does not leave the nozzle facing the droplet flight space in the sealed state. Herein, the valve 9 is controlled so as to be opened when ink filling starts, and closed when filling ends. In step S46, the valve 102 is closed. In step S47, the pressurizing pump 11 is operated to increase the pressure of the ink inside the pump-side liquid chamber 106 up to a pressure whereby liquid column formation can be conducted. The pressure is increased by a pressure control described later. Meanwhile, the pressurizing pump 22 is also operated to increase the gas pressure inside the droplet flight space in the sealed state. In step S48, the valve 102 is opened. In so doing, the whole ink from the pump to the nozzle enters a highly pressurized state.

Thereafter, the processing in steps S49 to S54 respectively similar to steps S6 to S11 in FIG. 6 is conducted and the initialization operations conducted prior to printing completed.

Figure 13:
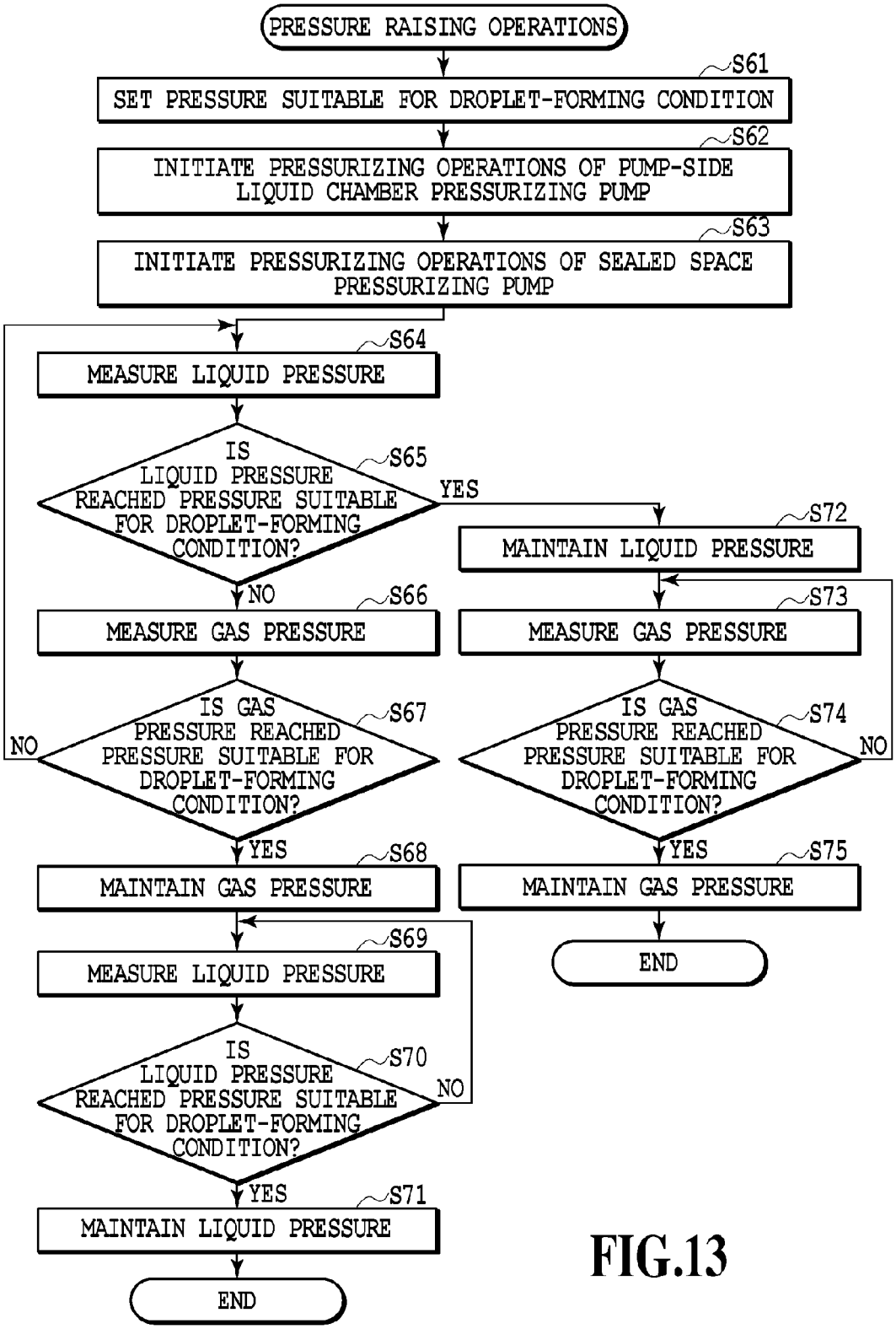
FIG. 13 is a flowchart illustrating details of a pressure control sequence conducted during the process in FIG. 12.

Details of the pressure control conducted in step S47 will now be described with reference to FIG. 13. First, in step S61, a pressure suitable for droplet-forming condition and a pressure condition for air inside the droplet flight space, similarly to step S21 in FIG. 7. In step S62, operation of the pressurizing pump 11 is started in order to pressurize the pump-side liquid chamber 106. In step S63, operation of the pressurizing pump 22 is started in order to pressurize the sealed space. In step S64, the measured value of the pressure sensor 108 for liquid is sent to the controller 5. In step S65 it is determined whether or not the liquid pressure has reached the pressure suitable for droplet-forming condition. The process proceeds to step S66 in the case of a negative determination, while proceeding to step S72 in the case of a positive determination.

In step S66, the value of the gas pressure inside the droplet flight space measured by the pressure sensor 20 is sent to the controller 5. Next, in step S67, it is determined whether or not the gas pressure has become equal to or greater than a pressure equivalent to the pressure suitable for droplet-forming condition. The process returns to step S64 in the case of a negative determination. In contrast, the process proceeds to step S68 in the case of a positive determination, and the pressurizing pump 22 is controlled so as to maintain the gas pressure at that point. Next, in step S69, the measured value of the pressure sensor 108 for liquid is sent to the controller 5, and in step S70, it is determined whether or not the liquid pressure has reached the pressure suitable for droplet-forming condition. The process returns to step S69 in the case of a negative determination. In contrast, the process proceeds to step S71 in the case of a positive determination, the pressurizing pump 11 is controlled so as to maintain the ink pressure at that point, and the present sequence is completed. Although the above corresponds to the case where the gas pressure reaches a pressure equivalent to the pressure suitable for droplet-forming condition sooner than the liquid pressure, both the air and the ink enter states maintaining a predetermined pressure when the present sequence is completed.

Meanwhile, in the case where it is determined in step S65 that the liquid pressure has reached the pressure suitable for droplet-forming condition, the process proceeds to step S72, and the pressurizing pump 11 is controlled so as to maintain the ink pressure at that point. Next, in step S73, the value of the gas pressure inside the droplet flight space measured by the pressure sensor 20 is sent to the controller 5. Then, in step S74, it is determined whether or not the gas pressure has become equal to or greater than a pressure equivalent to the pressure suitable for droplet-forming condition. The process returns to step S73 in the case of a negative determination. In contrast, the process proceeds to step S75 in the case of a positive determination, the pressurizing pump 22 is controlled so as to maintain the gas pressure at that point, and the present sequence ends. Although the above corresponds to the case where the liquid pressure reaches the pressure suitable for droplet-forming condition sooner than the gas pressure, both the air and the ink enter states maintaining the predetermined pressure when the present sequence is completed.

Figure 14:
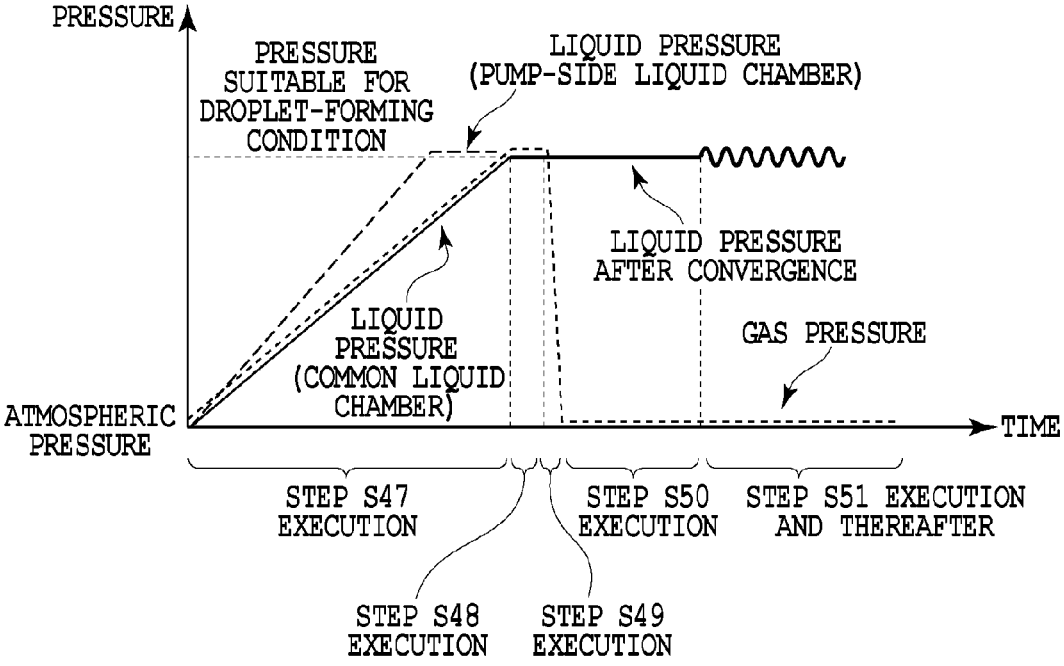
FIG. 14 is a graph illustrating pressure transitions in respective units in the case where the liquid pressure reaches a droplet-forming pressure before the gas pressure does when executing the process in FIG. 6.
Figure 15:
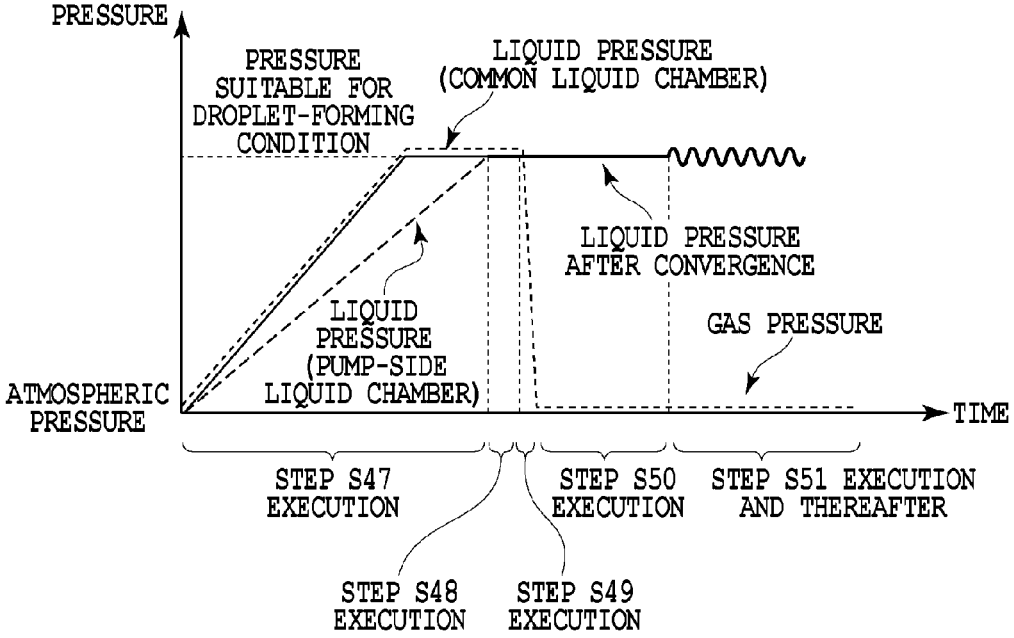
FIG. 15 is a graph illustrating pressure transitions in respective units in the case where the gas pressure reaches a pressure equivalent to a droplet-forming pressure before the liquid pressure does when executing the process in FIG. 6.

FIG. 14 is a graph illustrating pressure transitions in respective units in and after step S47 in the case where the liquid pressure reaches the pressure suitable for droplet-forming condition sooner than the gas pressure. FIG. 15 is a graph illustrating pressure transitions in respective units in and after step S47 in the case where the gas pressure reaches a pressure equivalent to the pressure suitable for droplet-forming condition sooner than the liquid pressure. As shown in these graphs, by executing step S47 (FIG. 13), both the ink pressure and the gas pressure increase, but a differential occurs between when the respective pressures reach the predetermined pressure. However, in either case, the inside of the common liquid chamber 6 is maintained at the pressure suitable for droplet-forming condition, while the inside of the droplet flight space is maintained at a pressure nearly equivalent to the pressure suitable for droplet-forming condition. In other words, the ejection of ink from the nozzle 1-3 (i.e., formation of a liquid column) does not occur in this state. Consequently, advantages similar to the first embodiment are obtained by performing the processing in step S48 and thereafter.

Others

The foregoing embodiments describe the case of use a n inkjet print head having a configuration which is a so-called a line head, wherein a nozzle and a corresponding droplet outlet are arrayed along the widthwise direction of a print medium to be printed upon and across a range corresponding to the full width of the print medium. In this case, the configuration may use a single head or an arrangement of plural heads in order to satisfy the length of the above range. In the latter case, it is possible to make the apparatus more compact and simply the control system by sharing pumps, driving sources for the pumps, and sensors. Also, the present invention is not limited to a printing apparatus that uses one or more heads in a line head configuration like the above, and it is also possible to apply the present invention to a printing apparatus having a configuration which is a so-called a serial printer, wherein an image is printed by repeatedly moving a print head and conveying a print medium in alternation.

Furthermore, the foregoing described embodiments in which the present invention is applied to continuous printing apparatus that create a state wherein liquid is regularly ejected from a nozzle as droplets by applying continuous pressure to liquid with a pump to push the liquid out from a nozzle, and additionally applying vibration with a vibration unit. However, the present invention is also applicable to a printing apparatus having a configuration that applies continuous pressure to liquid with a pump to push the liquid out from a nozzle, additionally contributes a factor to droplet formation from a liquid column by applying thermal pulses to the liquid near the nozzle, and ultimately forms droplets in response to the thermal pulses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-145434, filed Jun. 25, 2010, which is hereby incorporated by reference herein in its entirety.

What is claimed is:

1. A liquid ejection apparatus comprising:

a liquid ejection head that causes liquid stored in a liquid chamber communicating with a nozzle to be ejected from the nozzle and fly as droplets;

a sealing member that seals a space including the nozzle;

a first pressurizing unit that pressurizes the inside of the space;

a second pressurizing unit that pressurizes the inside of the liquid chamber;

a valve that communicates the inside of the space with the atmosphere; and a control unit that controls the sealing member, the first pressurizing unit, the second pressurizing unit, and the valve, the control unit, in a state wherein the sealing member has sealed the space and the valve is closed, controlling to increase the pressure of gas inside the space by means of the first pressurizing unit and also increase the pressure of liquid inside the liquid chamber by means of the second pressurizing unit while maintaining the pressure of the gas inside the space equal to or greater than the pressure of the liquid inside the liquid chamber, and then the control unit controlling to return the pressure of the gas inside the space to atmospheric pressure by opening the valve, such that ejection of liquid from the nozzle is initiated.

2. The liquid ejection apparatus according to claim 1, further comprising:

a deflecting unit able to deflect the flying droplets so as to separate droplets to be applied to a medium from droplets not to be applied to the medium; and a collecting unit that collects the droplets not to be applied to the medium, wherein the control unit drives the deflecting unit such that all the droplets are collected by the collecting unit until the sealing member releases the seal on the space and operations to apply droplets to the medium are initiated.

3. The liquid ejection apparatus according to claim 1, further comprising:

a secondary liquid chamber that stores the liquid and is disposed between the second pressurizing unit and the liquid chamber; and an on-off valve interposed in a flow channel between the secondary liquid chamber and the liquid chamber, thereby making it possible to pressurize liquid stored in the secondary liquid chamber independently of the liquid chamber by closing the on-off valve, and making it possible to communicate the secondary liquid chamber with the liquid chamber by opening the on-off valve.

4. A liquid ejection method executed by a liquid ejection apparatus having a liquid ejection head that causes liquid stored in a liquid chamber communicating with a nozzle to be ejected from the nozzle and fly as droplets and a sealing member that seals a space including the nozzle, the liquid ejection method comprising the steps of:

increasing the pressure of gas inside the space and also increasing the pressure of liquid inside the liquid chamber while keeping the pressure of the gas inside the space equal to or greater than the pressure of the liquid inside the liquid chamber, in a state wherein the sealing member has sealed the space; and returning the pressure of the gas inside the space to atmospheric pressure and initiating ejection of liquid from the nozzle.

* * * * *